United States Patent [19]

Ames et al.

[11] 4,215,560

[45] Aug. 5, 1980

[54] PROCESS AND DEVICE FOR MANUFACTURING COMPOSITE SECTIONS AND SIMILAR PRODUCTS

[75] Inventors: Adolf Ames, Hilzingen, Fed. Rep. of Germany; Jean-Jacques Theler, Neunkirch, Switzerland; Alfred Wagner, Steisslingen, Fed. Rep. of Germany

[73] Assignee: Swiss Aluminium Ltd., Chippis, Switzerland

[21] Appl. No.: 21,935

[22] Filed: Mar. 19, 1979

Related U.S. Application Data

[63] Continuation-in-part of Ser. No. 593,040, Jul. 3, 1975, Pat. No. 4,167,866.

[30] Foreign Application Priority Data

Jan. 22, 1976 [DE] Fed. Rep. of Germany ..... 2432541

[51] Int. Cl.³ ..... B21C 23/22; B21C 25/06

[52] U.S. Cl. ..... 72/258; 72/261

[58] Field of Search ..... 72/258, 270, 261; 425/113, 114, 467; 264/171, 172, 176 R

[56] References Cited

U.S. PATENT DOCUMENTS

| | | | |
|---|---|---|---|
| 815,571 | 3/1906 | Williams | 425/114 |
| 2,331,139 | 10/1943 | Safford | 425/113 |
| 2,401,551 | 6/1946 | Cook, Jr. | 425/113 |
| 2,696,640 | 12/1954 | Wienand | 425/114 X |
| 2,754,543 | 7/1956 | Loew | 425/114 |
| 3,375,550 | 4/1968 | Klein | 425/114 X |
| 3,422,648 | 1/1969 | Lemelson | 72/258 X |
| 3,528,130 | 9/1970 | Lefevre et al. | 425/133.5 X |
| 3,697,209 | 10/1972 | Schiesser | 425/114 |
| 3,712,770 | 1/1973 | Arnaudin | 425/114 |
| 3,744,947 | 7/1973 | Skobel | 425/114 |
| 4,030,334 | 6/1977 | Wagner et al. | 72/258 |
| 4,080,816 | 3/1978 | Wagner et al. | 72/253 R |

FOREIGN PATENT DOCUMENTS

| | | | |
|---|---|---|---|
| 2208859 | 8/1973 | Fed. Rep. of Germany | 72/258 |
| 50-22972 | 8/1975 | Japan | 72/258 |
| 1309345 | 3/1973 | United Kingdom | 72/258 |
| 308787 | of 1971 | U.S.S.R. | 72/261 |

*Primary Examiner*—Lowell A. Larson
*Attorney, Agent, or Firm*—Bachman and LaPointe

[57] ABSTRACT

A process and device for manufacturing composite sections by means of extrusion are described. The composite sections comprise at least two components, one of which is fed into the stream of metal being extruded and is securely joined to the face of the product without coming into contact with the face of the extrusion die.

5 Claims, 10 Drawing Figures

FIG.2
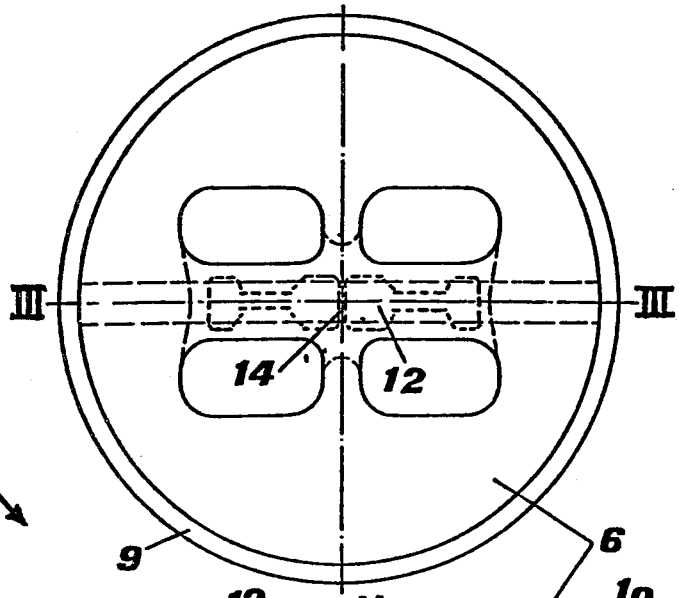
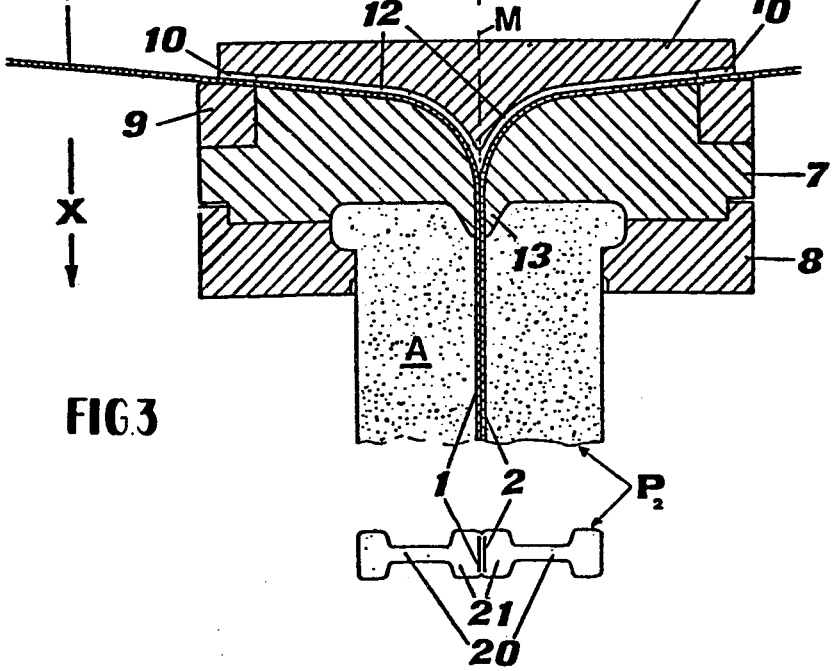
FIG.3

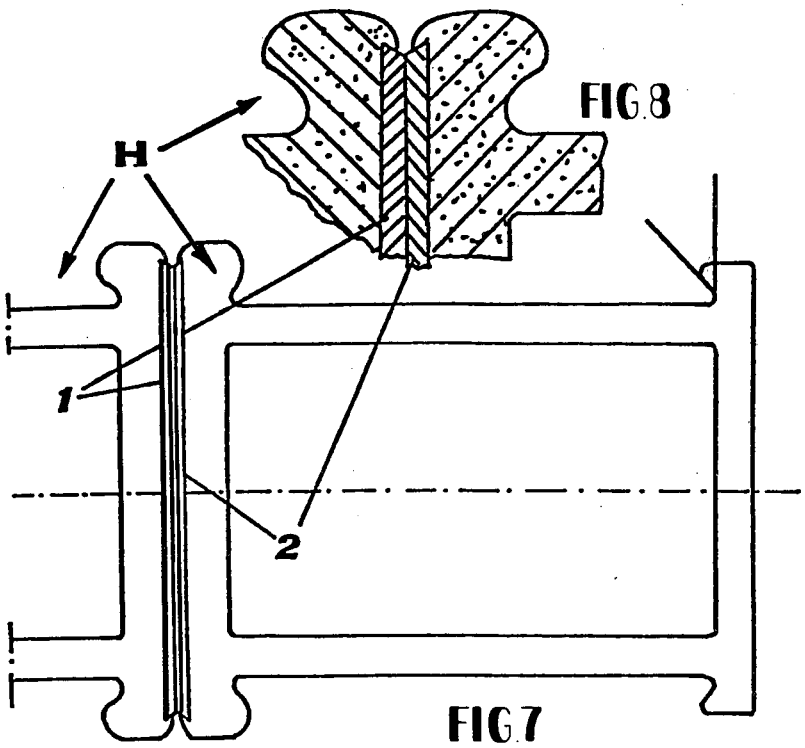
FIG.8
FIG.7
FIG.4
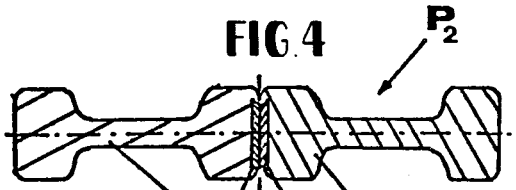
FIG.5
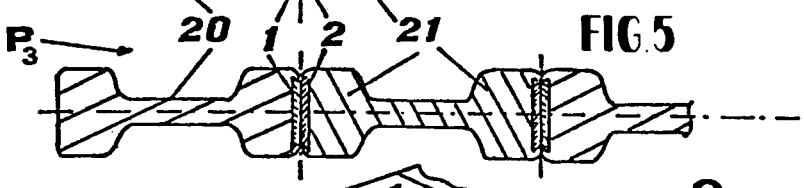
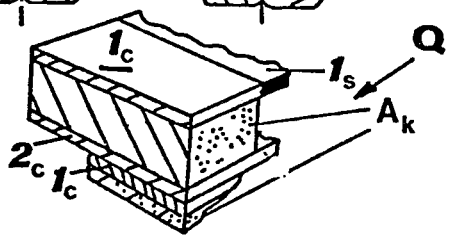
FIG.6

PROCESS AND DEVICE FOR MANUFACTURING COMPOSITE SECTIONS AND SIMILAR PRODUCTS

CROSS-REFERENCE TO RELATED APPLICATIONS

This case is a continuation-in-part of parent application Ser. No. 593,040, filed July 3, 1975 now U.S. Pat. No. 4,167,866, patented Sept. 18, 1979. In addition, reference is had to the related patent applications Ser. No. 594,034, filed July 8, 1975, now U.S. Pat. No. 4,080,816, patented Mar. 28, 1978, and Ser. No. 561,239, filed Mar. 24, 1975, now U.S. Pat. No. 4,030,334, patented June 21, 1977 all of which are assigned to the instant assignee.

BACKGROUND OF THE INVENTION

The invention concerns a process for manufacturing by means of extrusion composite sections or similar products comprising at least two component sections whereby one of the sections is introduced into the stream of metal which is the matrix, in particular a light metal matrix, as it is being extruded and concerns too a device with an extrusion tool having at least one die hole for carrying out this process.

A process is known whereby several steel wires are fed into the extrusion tool, parallel to the long axis of the tool, and leave it in the form of a reinforced section with the wires surrounded by the extruded matrix. The application of this process remains restricted to the production of internally reinforced sections.

In the case of another standard process for producing composite sections, a roll-clad metal strip is introduced into the chamber of an extrusion press die, and by applying a compressive force to the side which is not clad, is metallically bonded to the extruded section which is made of an appropriate material.

In view of this state of technological development, the inventor set himself the task of working out a process and device of the kind mentioned at the beginning, whereby non-clad metal strips or similar components could be intimately bonded to the matrix. Thereby, rubbing between the metal strip and the extrusion tool should be avoided and economical production of composite sections for many applications should be realized at a favorable cost.

These problems are solved by means of a process by which two separate sections or strips lying face to face are fed into the die and the strips bond intimately with the matrix which constitutes the other component and do so on the sides of the strips facing away from each other and at the same time the sides of the strips in contact with each other do not bond with each other, nor with the matrix. Each strip is then metallically bonded to the matrix on the side of the strip facing away from the other strip.

According to another feature of the invention, the two strips or similar sections run during the extrusion process in the separating plane between two neighboring holes in the die for simultaneous production of a pair of extrusion sections, preferably in the axis of symmetry between two openings of identical outline. In this way also several pairs of strips, spaced apart from each other, can pass through the hole in the die, whereby these composite sections are produced between any two particular pairs of strips.

This process has the advantage over other composite manufacturing process of utter simplicity because the joining of the section body to the covering layer requires no additional manufacturing step; the joining takes place during extrusion. The method of the invention also achieves considerable improvement over other methods of extruding composites in which the material of the composite comes into abrasive contact with the extrusion tool, because in accordance with the invention the composite material passes through the tool with the little contact and therefore without causing abrasion and is successfully bonded to the surface of the section. The cladding layer remains protected between the two neighboring, simultaneously extruded sections and, in addition, permits these sections to be separated without effort at the exit side of the die.

By appropriate preparation of the strips of cladding material, they can, in accordance with the invention, be mechanically engaged in the matrix by virtue of their shape, without it being disadvantageous to the separating of the sections. In the case of metallic bonding of the components, a suitable pretreatment is necessary viz., heating the strips and removing the oxide layer from the side which is to be bonded to the matrix.

In this way one can, for example, metallically bond a layer of stainless steel to an aluminum section and achieve a bond strength which is of the order of magnitude of the fracture strength of the matrix.

Such a bond strength, which can also be further aided by mechanical engagement due to appropriate shaping of the strip in the form of sloping edges along its length, allows the process of the invention to be used in particular for the manufacture of composite conductor rails due to the good interface properties with respect to mechanical strength corrosion and electrical resistance. It is of no consequence whether the section produced is a full or hollow section.

It has been found favorable to manufacture sections with a cladding layer in the form of a flat strip which is supplied and used in the tool without plating or covering with another metal or material. What is preferred, for example, are two strips of electrolytic copper which are joined to the matrix in a sandwich-like manner to give a rod like section, several of which can be extruded simultaneously without difficulty.

As many conductor rails are stressed only by clamping at certain points, there is a conductor rail or similar item produced by the process of the invention consisting of a core with a strip cladding which along its length is alternately of steel and non-ferrous metal; these lengths of strip of different material can be joined together at their ends in the described process without interrupting the continuity of the process.

It is a part of the invention that the strips or similar component parts are introduced as pairs in a common stream into the side of the extrusion press tool, or also as separate strips into different sides of the tool, and deflected through the tool to the die hole, and in the case of separate strips are brought together. This procedure permits continuous composite extrusion; the cladding material is fed into the side of the extrusion tool independent of shearing, billet loading, etc.

SUMMARY OF THE INVENTION

In accordance with the invention, in the device of an extrusion tool for carrying out the process having at least one die hole, there is provided at least one feeding channel, which accepts at least two strips or similar section inserts, and which runs from the outside of the extrusion tool to the die hole and tapers there forming a guiding slit across the long axis of the die hole, on both sides of which there are openings for the composite section.

The openings can have the same outline so that their plane of symmetry is determined by the guiding slit. It is also possible that several guiding slits are provided to allow simultaneous production of a series of composite sections.

In accordance with another feature, there are provided two radially approaching feeding channels which end in a common guiding slit, whereby each channel takes only one strip. To which degree the dividing wall between the two feeding channel parts, with respect to the taper section, can be ignored, depends on the requirements at the time.

In order to prevent bonding between the cores of the neighboring sections, in particular with light metal sections, the length of the guide-slit (s) should correspond approximately to the width of the die hole. Within the scope of the invention the extrusion tool is divided at least once transverse to the direction of extrusion because the facing strip has to be fed into the plane of symmetry of the die hole, with two partnering or so called tandem sections, a subdivision of the tool is necessary and also the provision of several appropriate entry holes. In the case of solid sections, the mandrel plate of the extrusion tool has no mandrel heads, in contrast to the extrusion tool for composite hollow sections.

The multi-component extrusion tool has, usefully, in one part at least one feeding groove, which the neighboring extrusion tool part makes into a feeding channel. An extrusion tool with feeding grooves in the mandrel plate has been found to be particularly useful and is such that an entry plate lies on one side of the mandrel plate covering over the feeding groove (s) and if necessary extending these grooves through guide-slits or openings and on the other side of the mandrel plate has a die plate which exhibits a die hole.

As a further improvement in this device and, in particular, to prevent abrasion in the curved region of the feeding channels, there should also be provided in at least one curved region and/or at the input opening of the feeding channel at least one feature which promotes easy slip; this is advantageously in the form of rolls which lie in the feeding channel perpendicular to the direction of movement of the strip or strips and rotate in that direction.

Thanks to these rolls individual strips or several strips together slide unimpeded through the feeding channel; no damage to the strip surface the occurs when, as is possible in some cases, a relatively pronounced curvature of the feeding channel is chosen.

In order to simplify the insertion and changing of the rolls, the groups of rolls can be inserted in units in which they can rotate and as such are mounted in the feeding channel.

In the case of an extrusion tool which is divided in at least one place perpendicular to the direction of extrusion and the parts of which delimit the feeding channel, it has been found favorable to insert the roll units or individual rolls in recesses in one part of the extrusion tool and to close these recesses with the other part. It is also possible to keep the rolls, for example, in loose bearings and to fix the bearings on the body of the tool, for example, by welding.

The sections simultaneously extruded in this device can be separated subsequently in such a way that each separate composite section is provided with at least one tightly adherent strip on its surface.

BRIEF DESCRIPTION OF THE DRAWINGS

Further advantages, details and features of the invention are presented in the following description of preferred embodiments with the aid of the diagrams viz.

FIG. 2: End view of an extrusion tool for the production of multiple composite sections.

FIG. 3: A section through the tool along the line III—III in FIG. 2.

FIG. 4 to FIG. 7: Various examples of multiple composite sections.

FIG. 8: An enlarged detail from FIG. 7.

DETAILED DESCRIPTION

Figure 1:
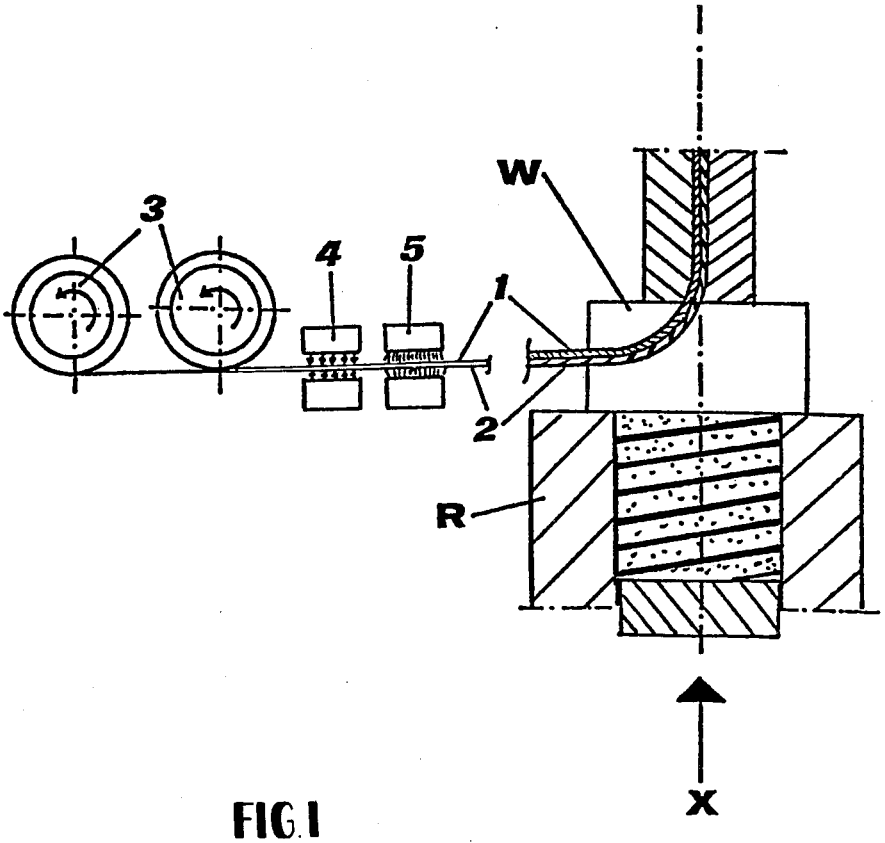
FIG. 1: A schematic drawing of the method of production of multiple composite sections.

FIG. 1 shows the container R of part of an extrusion press through the sides of the extrusion tool w of which two steel strips 1,2 are fed and are deflected into the extrusion direction x.

The two steel strips 1,2 are uncoiled from two reels 3, pass through a heating unit 4 and a brushing unit 5 where the adherent oxide is brushed off the strips 1,2 before entering the tool w.

The extrusion tool w comprises, progressing in the direction of extrusion, an entry plate 6, a mandrel plate 7 and a die plate 8. In the collar 9 of the disc shaped entry plate 6 which fits around the mandrel plate 7, there are provided diametrically facing entry slits 10 which, together with two matching grooves in the mandrel plate which are covered over by the entry plate 6, form two feeding channels 12 for the strips 1,2. These feeding channels 12 curve in towards the central axis M of the tool and terminate in a common slit 14 in a projection 13 in the mandrel plate.

The strips 1,2 emerge from the tool w together with the extruded light metal A in which they are embedded in such a way that they do not touch the extrusion tool in the region of the die.

The tandem extruded section $P_2$ shown in FIGS. 3 and 4 is made up of two I-beams sections 20 which make contact on their faces which have been clad with the strips 1,2. These strips 1,2 are metallurgically bonded to the light metal at the faces where they make contact and are free on the other side, so that separation of the two I-beam sections 20 can be carried out without difficulty.

The same arrangement but with several I-beam sections 20 is denoted by $P_3$ in FIG. 5.

In the case of the rectangular section Q in FIG. 6, two flat copper strips 1c and 2c surround, in a sandwich-like manner, a core $A_k$ of EC-aluminum. The copper cladding 1c, 2c of the section Q which is used in particular as conductor rails, can be replaced by intermediate steel strips $1_s$ over some stretches in order to save costs. For this a steel strip $1_s$ is fed into the tool on the copper strip 1c or 2c in desired lengths, and is drawn into the extrusion tool w by the copper strip 1c or 2c.

In the same way hollow sections H with separating metal cladding 1,2 is produced.

Figure 9:
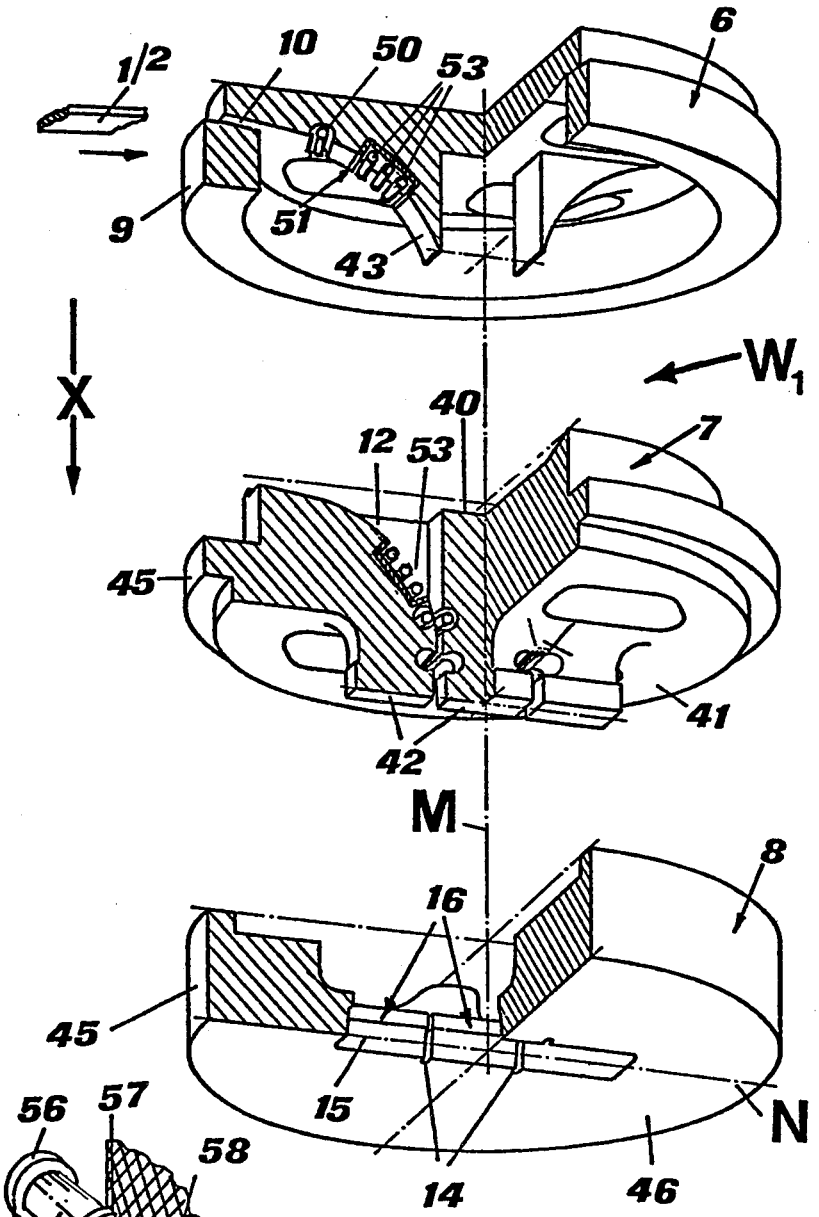
FIG. 9: An exploded view of an extrusion tool, part of which is sectioned to reveal more detail.

The extrusion tool $W_1$ shown in FIG. 9 is used for the simultaneous production of several hollow sections. Here there are provided in the entry plate side 40 of the mandrel plate 7 two diametrically placed grooves 12 which curve in towards the central axis M of the tool. They terminate at the other side 41 in the region of the die hole 15 as tapered slits 14 between three mandrel heads 42. At least during the extrusion process in each feeding channel 12, or depending on the specific requirements in only one of the channels, a strip 1,2 is inserted and fed in the direction of extrusion. The strips 1,2 divide the die hole 15 into two individual openings 16.

The entry plate 6 is provided with two projections 43 which fit partway into the feeding channels 12 when the entry plate 6 is placed on top of the mandrel plate 7 and thus form the feeding channels; these channels are extended further at one end by the slits 10 in the entry plate 6 up to the cylindrical outer wall 45 and at the other end by the tapered slits 14 up to the front face 46 of the extrusion tool $W_1$.

In the faces delimiting the feeding channels 12, there are provided individual rolls and series of rolls 53 with bearings in roll units which make it easier for the strips 1,2 to slide in the feeding channels 12.

Figure 10:
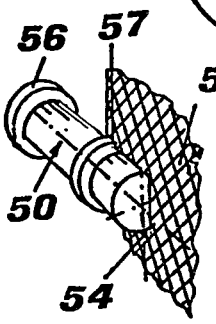
FIG. 10: An enlarged detail from FIG. 9 shown in perspective view.

In particular, in FIG. 10 one can see clearly the arrangement of an individual roll 50 in a recess 54 of the tool $W_1$; raised end parts 56 fixed on the rolls 50 which can rotate by virtue of bearings mounted in the recess 57 in the entry plate 6. If the mandrel plate 7 with corresponding recesses 57 is placed against the surface 58, cross hatched here to make it clearer, the two component parts 6,7 of the tool keep the rolls in their working position.

In an example not illustrated here, the raised end parts 56 are mounted freely on the rolls 50 and are tightly secured in the recesses 57.

The invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. In an extrusion device for manufacturing composite sections including at least a metal and two flat metal strips and comprising an entry plate, a mandrel plate and a die plate having a die opening defined therein with short and long axes, the improvement comprising: two substantially symmetrical feeding channels for feeding in said metal strips defined by at least some of said plates, said feeding channels extending through said mandrel plate and uniting unobstructedly thereby defining a passageway extending substantially parallel to said short axis at said die opening and opening into said die plate, whereby said metal and said metal strips are separate in said entry plate and said mandrel plate and contact each other in said die opening, wherein there is provided at least one region of curvature in said feeding channels to promote low friction.

2. The device as claimed in claim 1, further comprising roller means disposed in said feeding channels and operable to reduce the friction of said metal strips.

3. The device as claimed in claim 2, wherein said roller means comprise a plurality of cylinders detachably connected within said feeding channels.

4. The device as claimed in claim 2, wherein there are defined a plurality of recesses in said feeding channels defined by said extrusion tool and further comprising a plurality of rolling means detachably connected in said feeding channels and operable for reducing the friction encountered by said metal strips.

5. The device as claimed in claim 4, wherein said rolling means includes a guiding part for guiding said metal strips.

* * * * *